US006202460B1

(12) United States Patent
Gardon

(10) Patent No.: US 6,202,460 B1
(45) Date of Patent: Mar. 20, 2001

(54) METHOD AND DEVICE FOR PRODUCING A Y-FITTING FROM A METAL TUBE BY HYDROFORMING

(75) Inventor: Martin Gardon, Compiegne (FR)

(73) Assignee: Tubes Et Formes, Puteaux (FR)

( * ) Notice: Subject to any disclaimer, the term of this patent is extended or adjusted under 35 U.S.C. 154(b) by 0 days.

(21) Appl. No.: 09/467,172

(22) Filed: Dec. 20, 1999

(30) Foreign Application Priority Data

Dec. 18, 1998 (FR) ..... 98 16053

(51) Int. Cl.[7] ..... B21D 39/20; B21D 26/04
(52) U.S. Cl. ..... 72/58; 72/62
(58) Field of Search ..... 72/58, 61, 62

(56) References Cited

U.S. PATENT DOCUMENTS

| | | | | |
|---|---|---|---|---|
| 2,238,037 | * | 4/1941 | Cornell, Jr. | 72/58 |
| 3,216,092 | | 11/1965 | Arbogast . | |
| 3,681,960 | * | 8/1972 | Tadokoro | 72/61 |
| 4,051,704 | * | 10/1977 | Kimura | 72/58 |
| 5,765,420 | * | 6/1998 | Schaefer | 72/58 |
| 6,029,487 | * | 2/2000 | Genin et al. | 72/58 |

FOREIGN PATENT DOCUMENTS

| | | |
|---|---|---|
| 0 497 438 | 8/1992 | (EP) . |
| 0 633 075 | 1/1995 | (EP) . |
| 2 535 987 | 5/1984 | (FR) . |

* cited by examiner

*Primary Examiner*—David Jones
(74) *Attorney, Agent, or Firm*—Oblon, Spivak, McClelland, Maier & Neustadt, P.C.

(57) ABSTRACT

A method and device for producing a y-fitting having a y-branch from a metal tube by hydroforming. The device includes a die defining a cavity having a cylindrical portion, in which the tube is placed, and a branch, opening into the cylindrical portion and having a shape corresponding to the y-branch; opposed pistons configured to move inside the die to exert thrust on each end of the tube; an injection mechanism configured to inject a fluid into the tube at high pressure so that metal flows into the branch; a counter-plunger arranged in the branch and in contact with that portion of the tube facing the branch; and a displacement mechanism configured to displace the counter-plunger between a first position parallel to the axis of the tube and a second position perpendicular to the axis of the branch.

11 Claims, 3 Drawing Sheets

METHOD AND DEVICE FOR PRODUCING A Y-FITTING FROM A METAL TUBE BY HYDROFORMING

CROSS-REFERENCE TO RELATED APPLICATIONS

This application claims priority to French Application No. 98 16053 filed Dec. 18, 1998.

BACKGROUND OF THE INVENTION

1. Field of the Invention

The present invention relates to a method and to a device for producing a y-fitting having a y-branch from a metal tube by hydroforming. In many fields, use is made of tubular metal parts which comprise a main portion to which a y-branch is connected. These parts are commonly used, for example, to form connections or branches in pipes in which a fluid flows.

2. Description of the Related Art

To manufacture this kind of part it is known to use a method called hydroforming which consists in placing a straight, or curved, metal tube in a cavity of a die comprising a branch corresponding to the desired shape of the y-branch that is to be produced and in gradually causing the metal to flow into this y-fitting by applying pressure to the inside of the metal tube.

For this purpose, a fluid is injected at high pressure into the tube and at the same time pistons, which can move in the die, are applied in a sealed manner to each end of the tube so as to exert thrust on these ends and force the metal to flow into the branch of the die. Then, the free end of the y-branch is cut off so as to open the tapping.

The flow of metal into the branch is controlled by a counter-plunger arranged in the branch and moving in translational movement at the same time as the metal gradually forms the y-branch under the effect of the pressure exerted on the inside of the tube. The counter-plunger is connected to an element which exerts resistance to, or a force which opposes, the flow of metal during the displacement of this counter-plunger in the branch so as to allow the metal to flow uniformly.

However, the known devices used for producing a y-fitting from a metal tube have drawbacks. Specifically, the counter-plunger can be moved in translational movement in the branch of the die between a first position located close to the region where the cylindrical portion and the branch meet and a second position away from this region and separated by a distance which corresponds to the length of the y-branch that is to be produced. Depending on the device used, the counter-plunger extends into the branch either at a right angle with respect to the axis of the branch or parallel to the axis of the cylindrical portion of the die cavity.

When the counter-plunger extends at a right angle with respect to the axis of the branch, an empty space remains, when the counter-plunger is in the first position, between the counter-plunger and that portion of the tube facing the branch. This free space prohibits or impedes the control of the metal flow at the start of the deformation of the branch, which creates a risk that the metal bursts.

When the counter-plunger extends parallel to the axis of the cylindrical portion of the die cavity, the y-branch produced by the flow of metal into the branch has an end wall which also extends parallel to the axis of the tube. The free end of the y-branch is cut off in a direction at a right angle with respect to the axis of this y-branch so that part of the y-branch is removed, thus reducing its length.

SUMMARY OF THE INVENTION

Accordingly, an object of the present invention is to provide a hydroforming method and device, for producing a y-fitting from a metal tube, that avoids the aforementioned drawbacks.

In a first embodiment, the present invention provides a hydroforming method for producing an inclined y-branch from a metal tube, in this method the tube is placed in a die comprising a cavity formed of a cylindrical portion configured to take the tube and of a branch corresponding to the desired shape of the y-branch. A fluid is injected at high pressure into the tube and at the same time thrust is exerted on each end of the tube to force the metal to flow into the branch. The frontal surface of the metal in the branch is first restrained along a surface parallel to the axis of the tube and, as the metal flows into the said branch, the frontal surface of the metal is oriented along a surface perpendicular to the axis of the branch.

According to different embodiments of the present invention, the frontal surface of the metal is oriented at a right angle with respect to the axis of the branch either:

while the metal is flowing in the branch, or as the metal starts to flow into the branch, or as the metal finishes to flow in the branch.

Another embodiment of the present invention is a device for producing a straight and inclined y-branch from a metal tube by hydroforming, including:

a die comprising a cavity formed of a cylindrical portion, configured to take the tube, and of a branch, opening into the cylindrical portion and of a shape that corresponds to the y-branch, opposed pistons configured to move inside the die to exert thrust on each end of the tube, an injection mechanism configured to inject a fluid into the tube at high pressure so as to force the metal to flow into the branch, a counter-plunger arranged in the branch and in contact with that portion of the tube which is facing the branch, and a displacement mechanism configured to drive the translational and rotational movement of the counterplunger so as to displace the counter-plunger between a first position parallel to the axis of the tube as the metal starts to flow into the branch, and a second position at a right angle with respect to the axis of the branch while the metal is flowing in the branch.

According to another embodiment of the present invention, the displacement mechanism includes a ram which can be rotated through 180° and which comprises a piston rod connected to the counter-plunger by a crank.

In another embodiment, the axis of the piston rod of the ram forms, with the vertical, an angle equal to half the angle of inclination of the tapping.

According to another embodiment, the axis of the piston rod of the ram passes through a point located on the axis of the y-branch and at the mid-point of the distance separating 1) the center of the area of contact between the counter-plunger and the tube portion before the metal flows and 2) the center of the area of contact between the counter-plunger and the frontal surface of the metal after this metal has flowed into the branch.

According to another embodiment, the projection, onto the axis of the tube, of the distance between the point of intersection of the axis of the piston rod and the axis of the y-branch, and the center of the area of contact between the counter-plunger and the tube portion before the metal flows, is equal to the projection, onto the axis of the tube, of the distance between this point of intersection and the center of the area of contact between the counter-plunger and the frontal surface of the metal after this metal has flowed into the branch.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
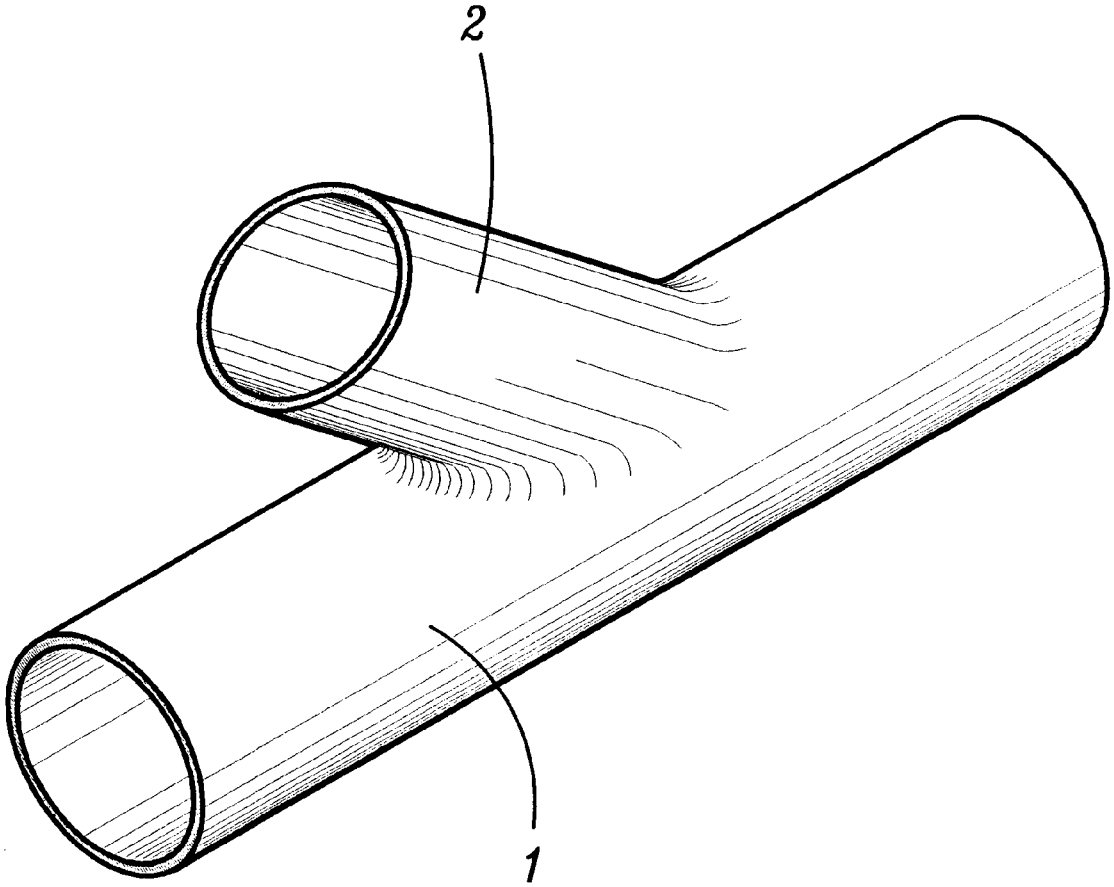
FIG. 1 is a diagrammatic perspective view of one example of a part obtained by a device according to the present invention.

Referring now to the drawings, wherein like reference numerals designate identical or corresponding parts throughout the several views, a part produced using the device according to the present invention is shown in FIG. 1. The part includes a tubular main part 1 and a straight y-branch 2, which is inclined at an angle. This y-branch 2 is produced by hydroforming from a metal tube 3 and using a device shown in FIGS. 2 and 3.

This hydroforming device comprises a die 10 which has a cavity denoted overall by the reference 11 and which is formed of a cylindrical portion 12 configured to take the tube 3 and of a branch 13 opening into the cylindrical portion 12 and of a shape that corresponds to the y-branch 2. The branch 13 is inclined along an axis YY' with respect to the vertical by an angle $\alpha$ equal to the angle of inclination of the y-branch 2.

The hydroforming device also includes opposed pistons 14 configured to move in the cylindrical portion 12 formed in the die 10, and injection mechanism 15 configured to inject fluid at high pressure into the metal tube 3.

The hydroforming device further includes a counter-plunger 20 arranged in the branch 13 formed in the die 10 and a displacement mechanism denoted by the general reference 30 for moving the counter-plunger 20 translationnally and rotationnally. The displacement mechanism 30 can include a ram 31 mounted so that it can rotate on a jig, not depicted, and which comprises a piston rod 32. The ram 31 is rotated through 180° using, for example, an electric motor 33, the output shaft of which is equipped with a pinion 34, which meshes with a gear wheel 35 mounted on the body of the ram 31. The rotational movement of the ram 31 may be caused by any other appropriate system.

The free end of the piston rod 32 is connected to the counter-plunger 20 via a crank 21. This crank 21 therefore has a first end 21*a* connected to the counter-plunger 20 and a second end 21*b* connected to the piston rod 32 of the ram 31. The axis ZZ' of the piston rod 32 of the ram 31 forms with the vertical an angle $\beta$ equal to half the angle $\alpha$ of inclination of the y-branch 2.

Figure 2:
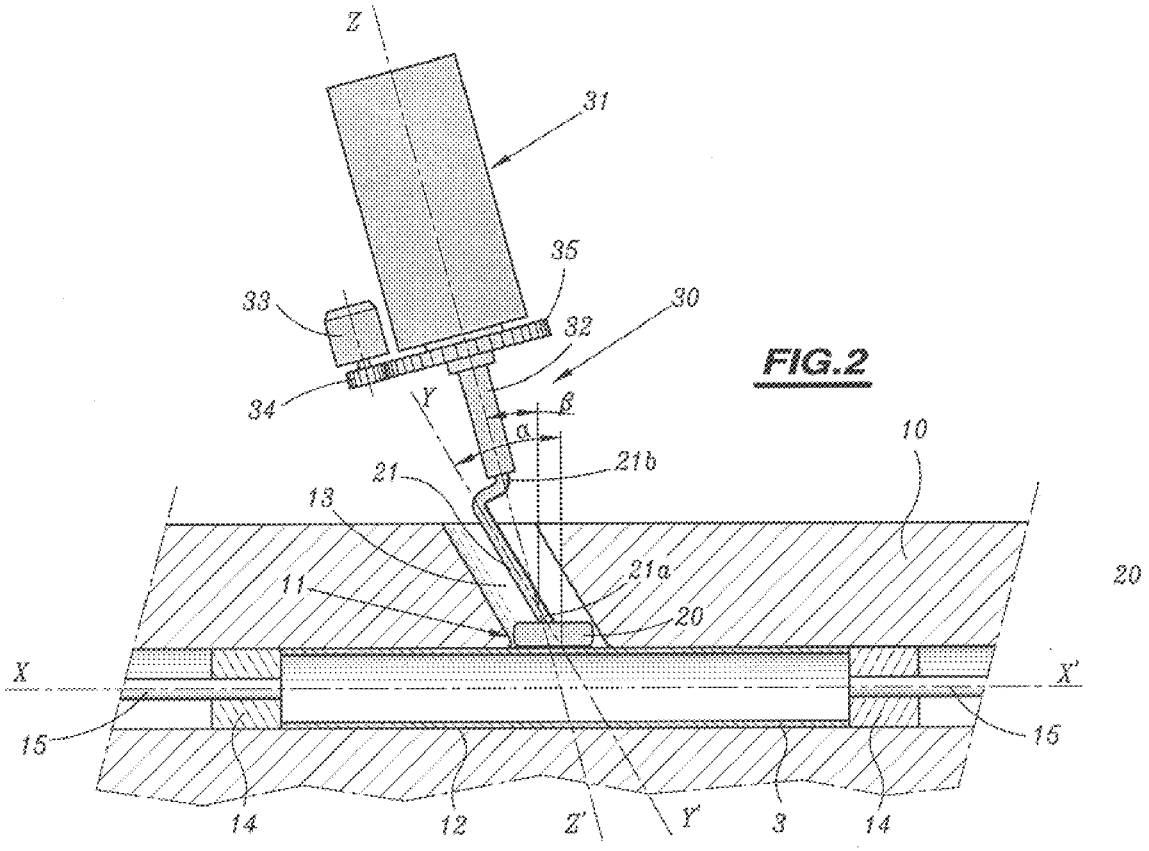
FIGS. 2 and 3 are diagrammatic views in cross-section of the device according to the present invention showing the various stages in producing the part shown in FIG. 1.
Figure 3:
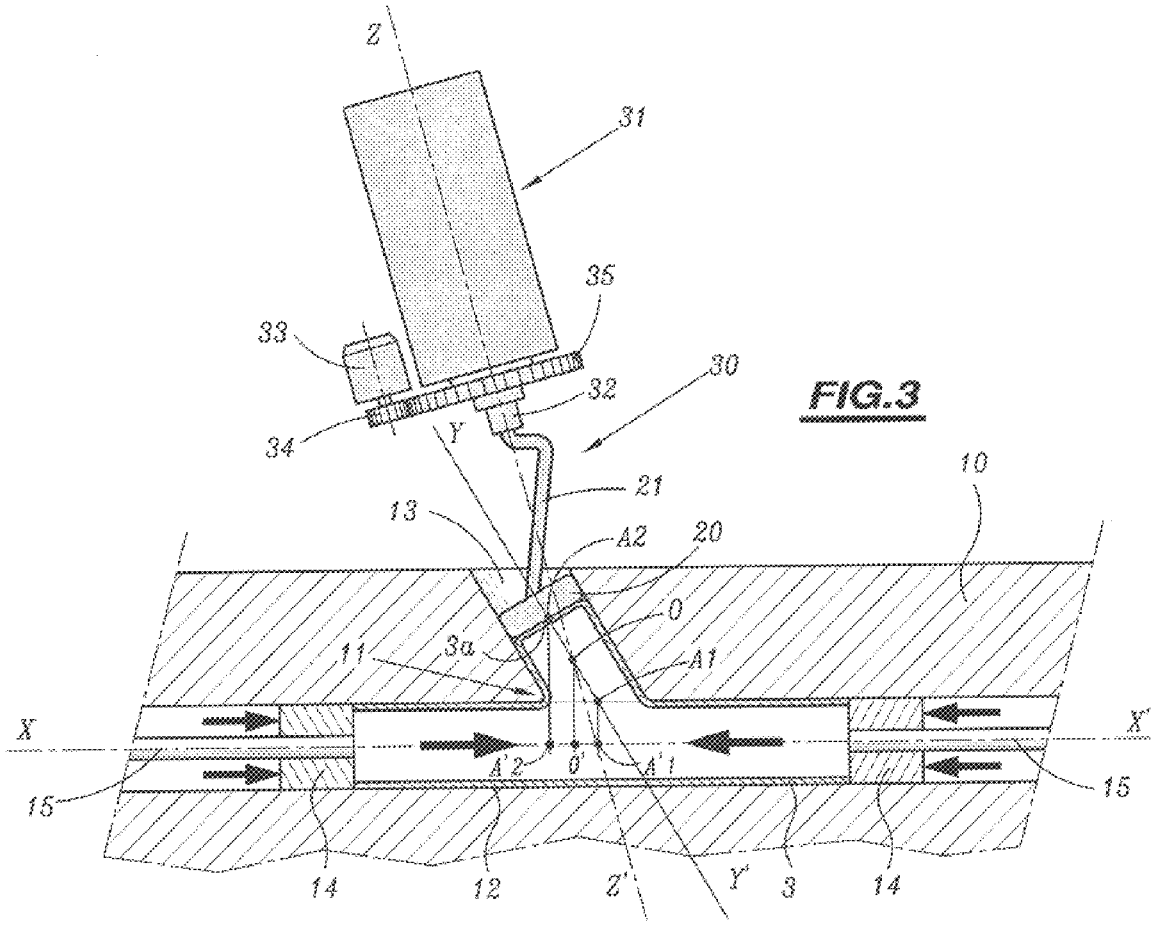

In the embodiment depicted in FIGS. 2 and 3, the simultaneous movement of the piston rod 32 in terms of translation and in terms of rotation on the one hand, by means of the ram 31 and, on the other hand, by means of the motor 33, the pinion 34 and the ring gear 35 also, by virtue of the crank 21, causes the translational and rotational movement of the counter-plunger 20. As a result of this movement, the counter-plunger 20 moves between a first position parallel to the axis XX' of the tube 3, as depicted in FIG. 2, and a second position at a right angle with respect to the axis YY' of the branch 13, as depicted in FIG. 3. The movement of the counter-plunger 20 between the two positions corresponds to a rotation of the crank 21 through 180°.

In the method of the present invention, the cylindrical tube 3 is placed in the cylindrical portion 12 of the cavity 11 and a piston 14 is applied to each end of this cylindrical tube 3. Then, the pistons 14 are moved closer together so as to compress the cylindrical tube 3 and, at the same time, the fluid is injected at high pressure into the tube 3 by the pipes 15. As the pressure exerted by the pistons 14 on the cylindrical tube 3 increases, the pressure exerted by the fluid from the inside of this tube 3 also increases.

At the start of this phase, the counter-plunger 20 is in the position depicted in FIG. 2, in which the contact surface of the counter-plunger 20 presses against that portion of the tube 3 which lies facing the branch 13 of the cavity 11. Thus, under the combined effect of the pressure exerted by the pistons 14 on the tube 3 and of the hydraulic fluid inside this tube 3, the metal, of which this cylindrical tube 3 is made, tends to flow into the branch 13.

As soon as the metal flows into this branch 13, the frontal surface 3*a* of the metal flowing into the branch 13 is restrained along a surface parallel to the axis XX' of the tube 3 because this counter-plunger 20 extends parallel to the axis XX'.

At the same time as the pistons 14 are being brought closer together and as fluid is being injected into the tube 3, the ram 31 and the motor 33 are actuated and so as to cause the assembly including the piston rod 32, the crank 21 and the counter-plunger 20 to rotate and to translate in the direction of flow of the metal in the branch 13. Thus, as the metal flows into the branch 13, the counter-plunger 20 moves between the first position, in which this counter-plunger 20 is parallel to the axis XX' of the tube 3, and the second position, in which the counter-plunger 20 extends at a right angle with respect to the axis YY' of the tapping 2. The frontal surface 3*a* of the y-branch 2 is thus oriented at a right angle with respect to the axis YY' of the branch 13, as shown in FIG. 3.

Throughout the travel of the metal flowing in the branch 13, the frontal surface 3*a* is in contact with the contact surface of the counter-plunger 20, thus preventing the formation of wrinkles or cracks in the metal flowing in the branch 13. The flow of metal in the branch 13 is controlled by the counter-plunger 20 which, under the effect of the ram 31, exerts resistance to, or a force which opposes, this flow as this counter-plunger moves, to thus allow the metal to flow uniformly.

The axis ZZ' of the piston rod 32 of the ram 31 passes through a point O, located on the axis YY' of the y-branch 2 and at the mid-point of the distance separating the center A1 of the area of contact between the counter-plunger 20 and the tube 3 portion before the metal flows and the center A2 of the area of contact between the counter-plunger 20 and the frontal surface 3*a* of the metal after this metal has flowed into the branch 13.

In addition, the projection O'A'1 onto the axis XX' of the tube 3 of the distance between point of intersection O and the center A1, is equal to the projection O'A'2 onto the axis XX' of the distance between point of intersection O and the center A2.

In the embodiment described above, the rotation of the counter-plunger 20 gradually orients the frontal surface 3*a* of the metal at a right angle with respect to the axis YY', of the y-branch 2 while the metal flows in the branch 13.

According to an alternative embodiment, the counter-plunger 20 is rotated at the start of the translational movement of this counter-plunger 20 so as to orient the frontal surface of the metal at a right angle with respect to the axis YY' of the y-branch 2 as soon as this metal starts to flow into the branch 13.

According to yet another embodiment, the counter-plunger 20 is rotated at the end of the flow of metal in the branch 13 so as to orient the frontal surface 3*a* of the metal at a right angle with respect to the axis of the branch 13 at the end of the flow of this metal.

The counter-plunger 20 can be rotated for all the positions thereof between the two extreme positions, that is to say the first position at the start of flow and the second position at the end of flow of the metal in the branch 13.

The device according to the invention makes it possible to produce y-fitting with a y-branch which is longer than can be produced with a counter-plunger which is always oriented at a right angle with respect to the axis of the tube and makes it possible to avoid the risks of metal cracking or bursting at the start of deformation when the counter-plunger is always oriented at a right angle with respect to the axis of the tapping.

In the above description, the invention was applied to the production of a y-branch on a straight tube. However, the invention also applies to the production of a y-branch on a tube which has previously been curved, for example to form an elbow. Furthermore, the method and device according to the present invention also applies to the production of a y-branch which is not straight.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A hydroforming method for producing a Y-fitting from a metal tube having opposing ends placed in a die having a cavity defining a branch with a shape corresponding to a Y-branch of the Y-fitting, comprising:

injecting a fluid at high pressure into the metal tube;

exerting thrust on each opposing end of the metal tube during injecting said fluid, so that a flowing metal flows into said branch;

restraining said flowing metal along a first surface parallel to the axis of the metal tube when the flowing metal starts to flow into said branch; and changing an orientation of a frontal surface of the flowing metal to a second surface perpendicular to the axis of the branch after the flowing metal starts to flow into said branch, wherein the Y-branch of the Y-fitting is not perpendicular to the axis of the metal tube.

2. A method according to claim 1, wherein orienting the frontal surface of the flowing metal along the second surface perpendicular to the axis of the branch is performed while the flowing metal flows into the branch.

3. A method according to claim 1, wherein orienting the frontal surface of the flowing metal along the second surface perpendicular to the axis of the branch is performed while the flowing metal begins to flow into the branch.

4. A method according to claim 1, wherein orienting the frontal surface of the flowing metal along the second surface perpendicular to the axis of the branch is performed while the flowing metal finishes to flow into the branch.

5. A device for producing a Y-fitting from a metal tube having opposing ends by hydroforming, comprising:

a die defining a cavity having a cylindrical portion, in which the tube is placed, and a branch, opening into the cylindrical portion and having a shape corresponding to a Y-branch of the Y-fitting;

opposed pistons configured to move within the die to exert thrust on each opposing end of the metal tube;

an injection mechanism configured to inject a fluid into the metal tube at high pressure so that metal flows into the branch;

a counter-plunger arranged in the branch and in contact with a portion of the metal tube facing the branch; and a displacement mechanism configured to displace said counter-plunger between a first position parallel to the axis of the metal tube and a second position perpendicular to the axis of the branch, wherein the Y-branch of the Y-fitting is not perpendicular to the axis of the metal tube.

6. A device according to claim 5, wherein the displacement mechanism comprises:

a crank connected to said counter-plunger; and a ram rotatable through 180°, said ram comprising a piston rod connected to the said crank.

7. A device according to claim 6, wherein the axis of the piston rod forms, with a vertical axis, an angle equal to half an angle between the axis of the Y-branch and the vertical axis.

8. A device according to claim 6, wherein the axis of the piston rod passes through a point O, said point O being located on the axis of the Y-branch and at a mid-point of a distance separating a center A1 of an area of contact between the counter-plunger and the metal tube before the metal flows into the branch and the center A2 of an area of contact between the counter-plunger and the frontal surface of the metal after the metal has flowed into the branch.

9. A device according to claim 8, wherein a projection onto the axis of the metal tube of the distance between the point O and the center A1 is equal to a projection onto the axis of the metal tube of the distance between the point O and the center A2.

10. A device according to claim 7, wherein the axis of the piston rod passes through a point O, said point O being located on the axis of the Y-branch and at a mid-point of a distance separating a center A1 of an area of contact between the counter-plunger and the metal tube before the metal flows into the branch and the center A2 of an area of contact between the counter-plunger and the frontal surface of the metal after the metal has flowed into the branch.

11. A device according to claim 10, wherein a projection onto the axis of the metal tube of the distance between the point O and the center A1 is equal to a projection onto the axis of the metal tube of the distance between the point O and the center A2.

* * * * *